US006416124B1

(12) United States Patent
Chen et al.

(10) Patent No.: US 6,416,124 B1
(45) Date of Patent: Jul. 9, 2002

(54) HIGHCHAIR WITH HORIZONTALLY ADJUSTABLE TRAY

(75) Inventors: Er-Jui Chen, Feng-Shan; Hung-Chung Hou, Tai-Pao; Hsiu-Chiang Liang, Ping-Tung Hsien, all of (TW)

(73) Assignee: Link Treasure Limited, Tortola (VG)

( * ) Notice: Subject to any disclaimer, the term of this patent is extended or adjusted under 35 U.S.C. 154(b) by 0 days.

(21) Appl. No.: 09/642,214

(22) Filed: Aug. 17, 2000

(51) Int. Cl.[7] ..... A47B 39/00
(52) U.S. Cl. ..... 297/149; 297/151
(58) Field of Search ..... 297/149, 151, 297/153, 148; 108/143

(56) References Cited

U.S. PATENT DOCUMENTS 3,874,725 A * 4/1975 Perry ..... 297/149 X
4,671,574 A * 6/1987 Kassai ..... 297/149 X
4,723,813 A * 2/1988 Kassai ..... 297/149 X
5,118,161 A * 6/1992 Slowe et al. ..... 297/153
5,489,138 A * 2/1996 Mariol et al. ..... 297/151
5,507,550 A * 4/1996 Maloney ..... 297/149 X
5,992,932 A * 11/1999 Kain et al. ..... 297/151 X

* cited by examiner

*Primary Examiner*—Peter M. Cuomo
*Assistant Examiner*—Stephen Vu
(74) *Attorney, Agent, or Firm*—W. Wayne Liauh

(57) ABSTRACT

A highchair has a horizontally adjustable tray. It includes: (a) a pair of supports on opposed sides of the highchair each having a plurality of studs on an inside surface thereof; (b) a tray movably coupled between the supports including two underlying engagement members, each of the apertures having an elastic projection projected above the aperture; and (c) an actuator slidably attached to an undersurface of the tray including two vertical members each having a plurality of wedge members corresponding in position to the apertures of the engagement member and one or more elastic elements each having one end biased against the undersurface of the tray and the other end biased against the actuator. The projected elastic projections are structured to restrict the movements of the wedge members so as to effect the locking of the actuator to the tray, and the wedge members are structured to be able to move pass the retracted elastic projections to effect a disengagement of the actuator from the tray. In one embodiment, each of the supports also includes a tube disposed on a leg of the highchair and a plurality of studs releasably coupled to the highchair.

9 Claims, 8 Drawing Sheets

HIGHCHAIR WITH HORIZONTALLY ADJUSTABLE TRAY

BACKGROUND OF THE INVENTION

1. Field of Invention

The present invention relates to a highchair and more particularly to a highchair with horizontally adjustable tray with improved characteristics.

2. Related Art

Conventionally, parents buy a highchair to feed an infant. Typically, a highchair comprises a frame with long legs supported on a ground, a seat for supporting the infant, and a tray with food provided thereon.

A number of highchairs with either horizontally adjustable or fixed tray are found in a search such as Taiwanese Patent Publication Nos. 240,409 and 252,424, and 327,300, and U.S. Pat. Nos. 5,087,097, 5,118,161, 5,458,394, 5,507,550, and 5,586,800 wherein above No. 240,409 discloses a highchair with fixed tray and No. 327,300 discloses a highchair with horizontally adjustable tray.

But these are unsatisfactory for the purpose for which the invention is concerned because they are ineffective and/or complex in structure.

SUMMARY OF THE INVENTION

It is therefore an object of the present invention to provide a highchair with horizontally adjustable tray. The advantages of the present invention are realized by configuring the highchair to comprise a pair of supports on opposed sides of highchair each having a plurality of elastic projections on the inside; a movable tray coupled between the supports including a tray portion and two beneath engagement members put on the supports each having a plurality of apertures with the elastic projections biased in or out of the apertures for changing the relative positioning of tray with respect to the supports; and a movable actuator in the tray including two vertical members each having a plurality of wedge members corresponding to the apertures of the engagement member and two elastic elements each having one end biased against the inside of tray and the other end biased against actuator, thereby effecting the locking of the actuator to the tray by restricting the movements of wedge members by the projected elastic projections or the disengagement of the actuator from the tray by moving the wedge members to pass over the retracted elastic projections; whereby the tray is capable of positioning in a locked position or moving relative to the supports or even being removed from the supports.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become fully understood from the detailed description given hereinbelow illustration only, and thus are not limitative of the present invention, and wherein.

DETAILED DESCRIPTION OF THE INVENTION

Figure 4:
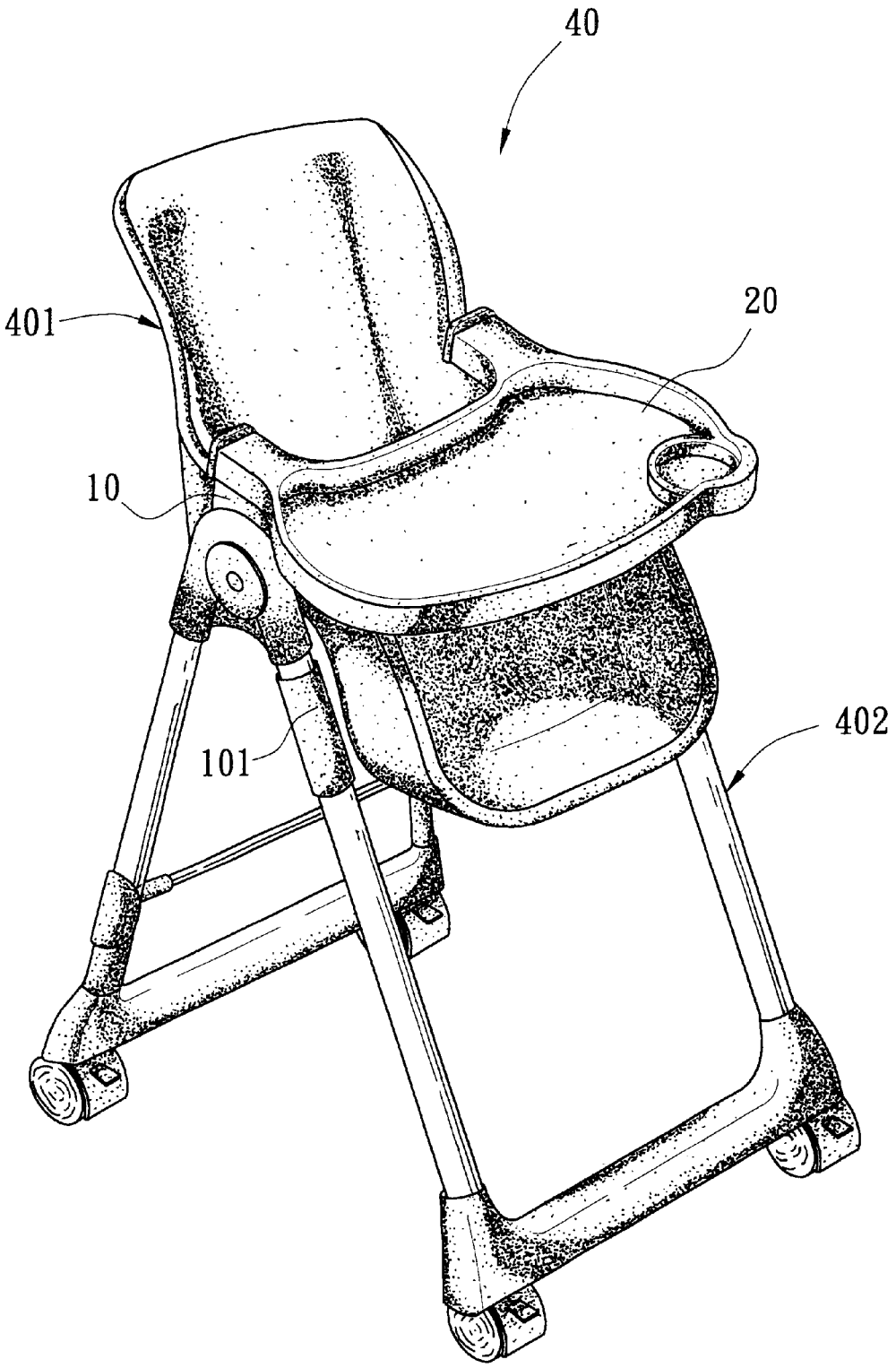
FIG. 4 is a perspective view of a highchair incorporating the horizontally adjustable tray shown in FIG 1.

Referring to FIG. 4, there is shown a highchair 40 incorporating a tray 20 constructed in accordance with the invention comprising a seat 401 and a frame 402 wherein tray 20 is horizontally provided in the front of seat 401 capable of being horizontally adjusted or removed from seat 401. The horizontally adjustable tray 20 is applicable to highchair or stroller.

Figure 1:
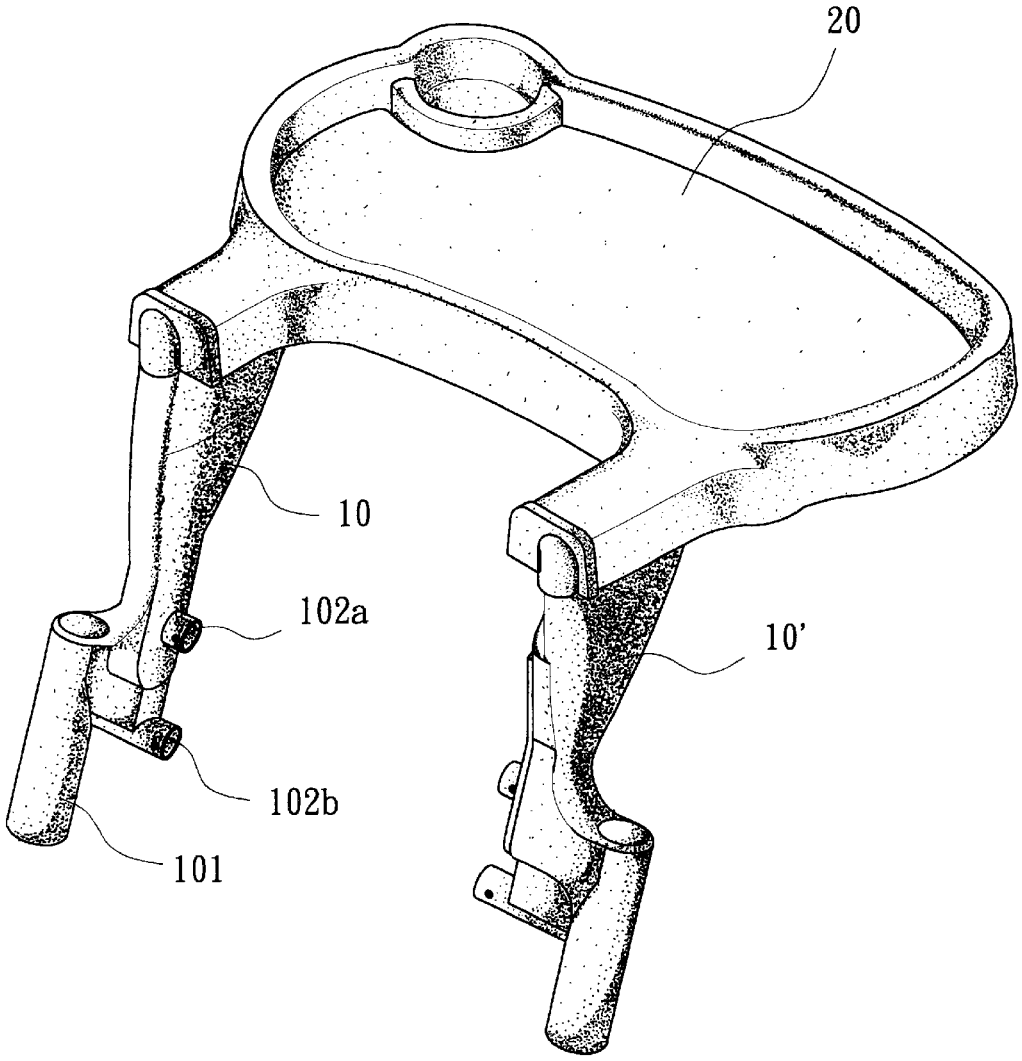
FIG. 1 is a perspective view of a horizontally adjustable tray of highchair of a first preferred embodiment according to the invention.
Figure 2:
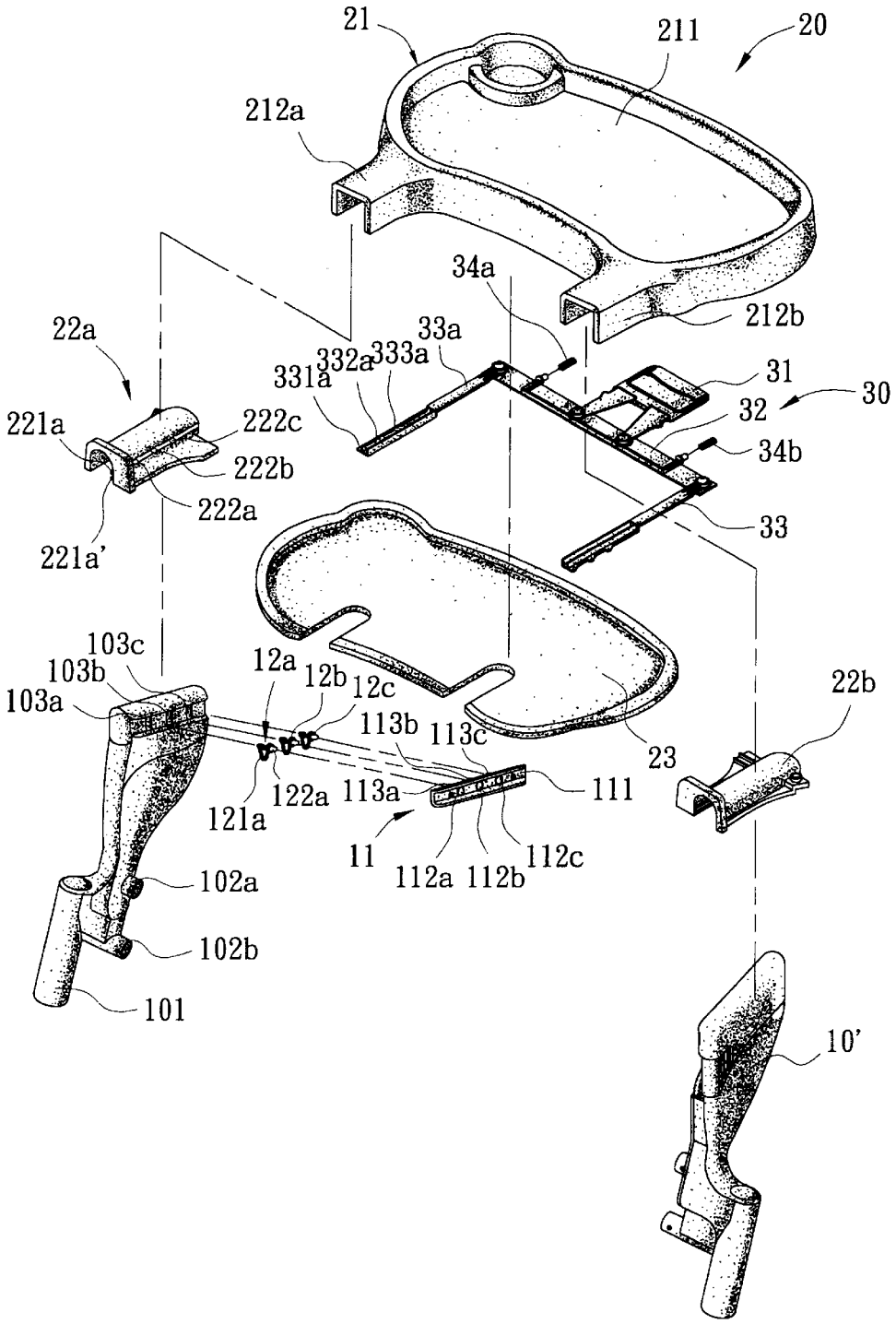
FIG. 2 is an exploded view of the FIG. 1 tray.

Referring to FIGS. 1 and 2, there is shown a horizontally adjustable tray assembly comprising a pair of supports 10, 10' on opposed sides of highchair 40, a tray 20, and an actuator 30. Note that since left parts of tray 20 and actuator 30 and support 10' are mirror images of their counterpart and support 10 respectively such that the following detailed description of left parts of tray 20 and actuator 30 and support 10 are sufficient.

Support 10 comprises a tube 101 put on leg 402, two studs 102*a*, 102*b* releasably coupled to highchair 40, a plurality of slots 103*a*, 103*b*, and 103*c*, an elongate member 11 comprising a channel 111 including holes 112*a*, 112*b*, and 112*c* corresponding to slots 103*a*, 103*b*, and 103*c* respectively, and recesses 113*a*, 113*b*, and 113*c* on the rear corresponding to holes 112*a*, 112*b*, and 112*c* each recess having an inverted U shape so as to form a receiving space and being inserted into slots 103*a*, 103*b*, and 103*c* respectively, and elastic projections 12*a*, 12*b*, 12*c* each elastic projection having a body (121*a*, 121*b*, or 121*c*) and a rounded tip (122*a*, 122*b*, or 122*c*) wherein each tip (122*a*, 122*b*, or 122*c*) is projected into the corresponding hole (112*a*, 112*b*, or 112*c*) in a locked position of tray 20 or cleared from the corresponding hole (122*a*, 122*b*, or 122*c*) in an operating position of tray 20.

Tray 20 comprises a tray portion 21, two engagement members 22*a*, 22*b*, and a base plate 23. Tray portion 21 generally has the same shape as base plate 23 so as to engage together to form a receiving area. Tray portion 21 has an oval shape comprising a flat central area 211 for retaining food or the like and n-shaped engagement channels 212*a*, 212*b*. Engagement member 22*a* is also n shape being snapped into engagement channel 212*a* such that tray 20 may move along supports 10, 10'. Two parallel rails 221*a*, 221*a'* are provided on the inside of engagement member 22*a*. The distance between rails 221*a* and 221*a'* is about the width of channel 111 of elongate member 11 such that channel 111 may insert in the rails 221*a*, 221*a'*. Apertures 222*a*, 222*b*, and 222*c* are formed in rails 221*a*, 221*a'* corresponding to holes 112*a*, 112*b*, and 112*c* respectively.

Actuator 30 is provided between base plate 23 and tray portion 21 comprising a handle 31, a horizontal member 32, two vertical members 33, and two elastic elements 34*a*, 34*b*. Handle 31 is coupled to horizontal member 32. Horizontal member 32 is coupled between one ends of vertical members 33. Vertical member 33*a* is engaged with the openings of apertures 222*a*, 222*b*, and 222*c* of engagement member 22*a*. Vertical member 33*a* comprises a plurality of wedge members 331*a*, 332*a*, and 333*a* corresponding to apertures 222*a*, 222*b*, and 222*c* respectively. Elastic element 34*a* has one end biased against the inside of tray 20 and the other end biased against horizontal member 32. As such, wedge members 331*a*, 332*a*, and 333*a* of vertical member 33*a* are disengaged from apertures 222*a*, 222*b*, and 222*c* of engagement member 22*a* in a locked position of tray 20 and actuator 30 by virtue of elastic elements 34*a*, 34*b* wherein elastic projections 12*a*, 12*b*, and 12*c* are projected away from apertures 222*a*, 222*b*, and 222*c* respectively (see FIG. 3A later). To the contrary, pull handle 31 against the elastic force of elastic elements 34*a*, 34*b*. Then cause wedge members 331*a*, 332*a*, and 333*a* of vertical member 33*a* to push elastic projections 12*a*, 12*b*, and 12*c* to force them to retract into apertures 222*a*, 222*b*, and 222*c* of engagement member 22*a* to overcome the obstruction of elastic projections 12*a*, 12*b*, and 12*c*. As a result, tray 20 is free to slide long supports 10, 10' or even removed from a device such as highchair. This position is called an operating position of tray 20 and actuator 30 (see FIG. 3B later).

Figure 3A:
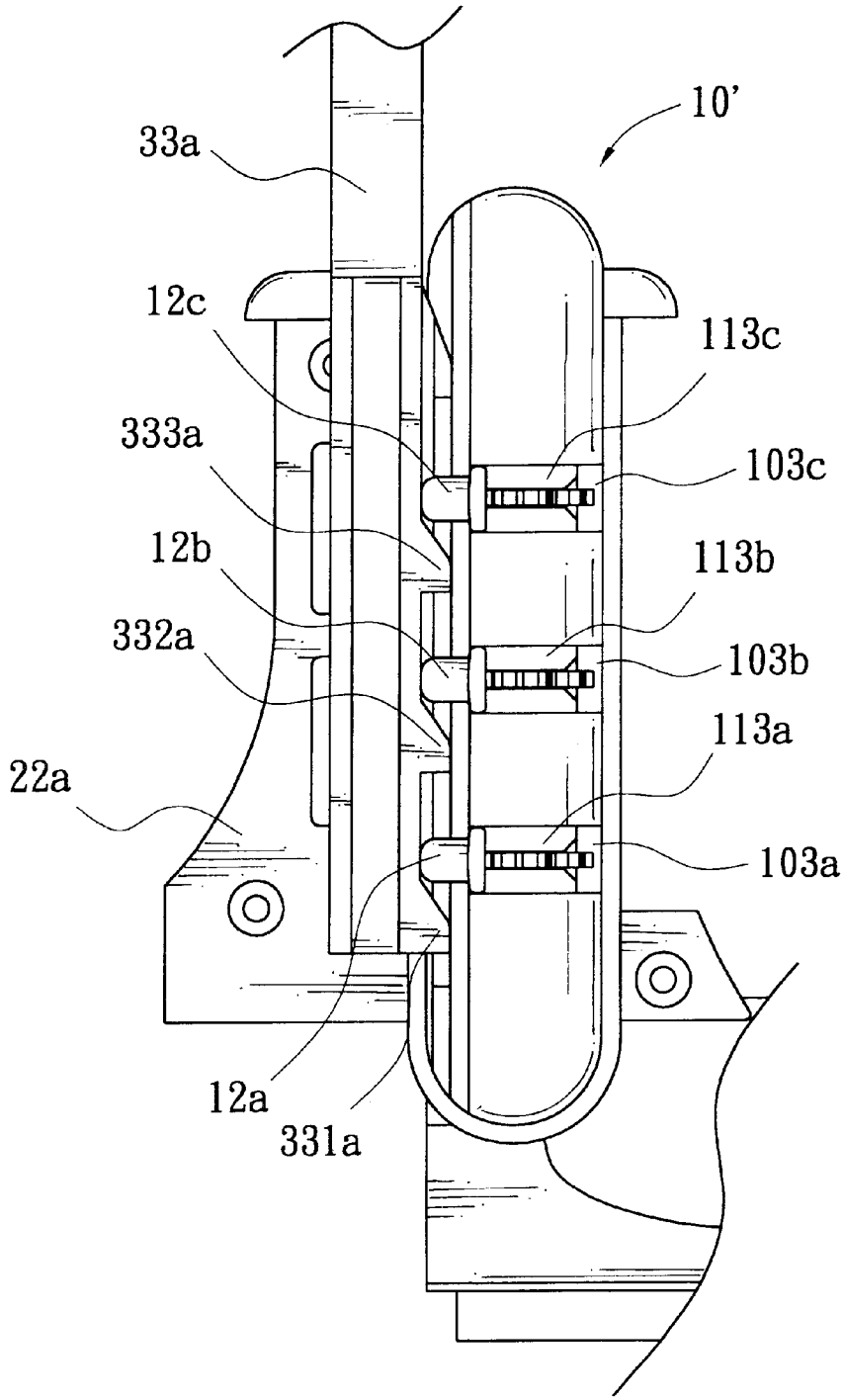
FIGS. 3A and 3B schematically depict operations of the FIG. 1 tray.
Figure 3B:
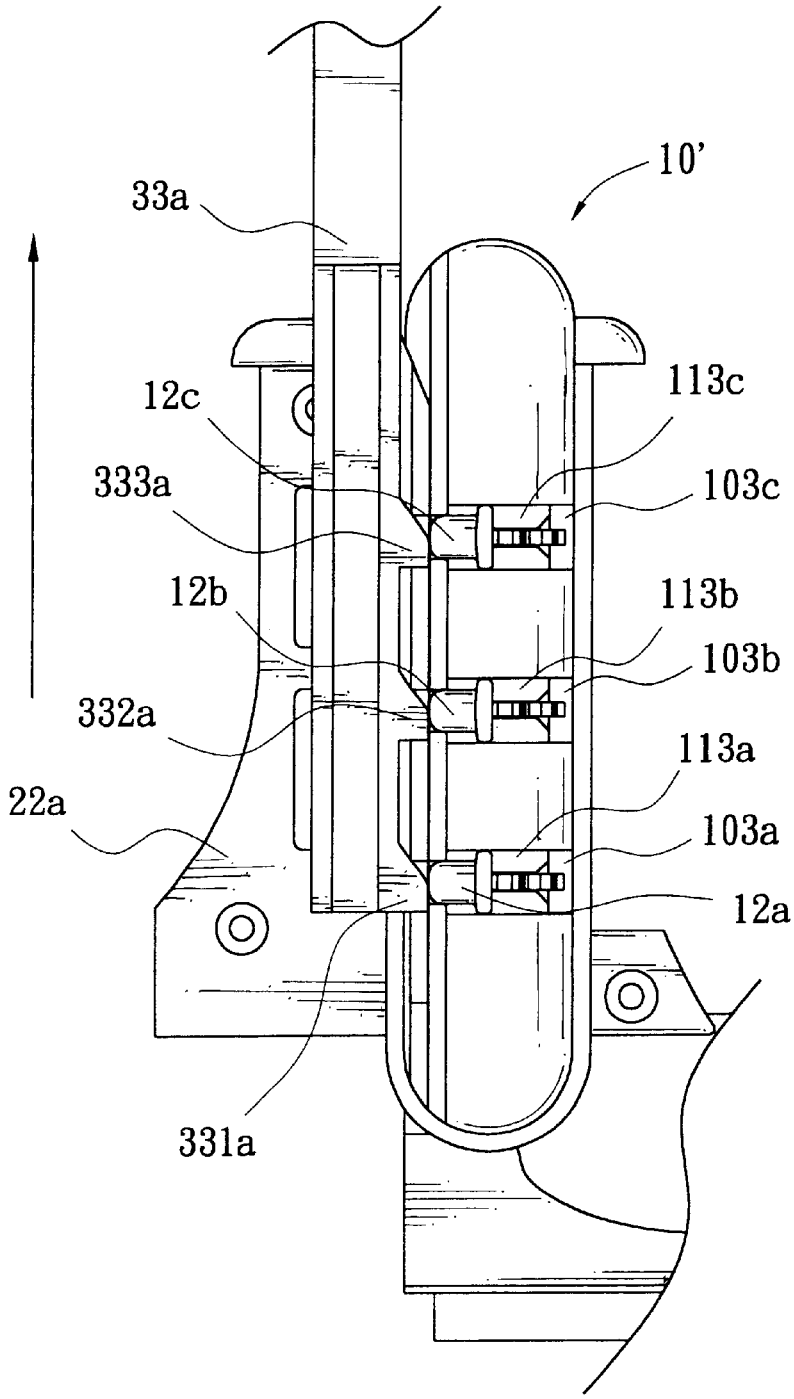

Referring to FIGS. 3A and 3B in conjunction with FIG. 4, assembly and operation of the tray 20 of the invention is now described below.

In assembling tray 20, put engagement member 22*a* on support 10 to cause channel 111 to insert in the rails 221*a*, 221*a'*. Next insert vertical member 33*a* into engagement member 22*a* to cause wedge members 331*a*, 332*a*, and 333*a* to block the openings of apertures 222*a*, 222*b*, and 222*c* of engagement member 22*a*. Then insert the above coupled elements into engagement channel 212*a* to a desired position. Next, further push handle 31 a small distance to cause wedge members 331*a*, 332*a*, and 333*a* to pass over apertures 222*a*, 222*b*, and 222*c* of engagement member 22*a*. At the same time, elastic projections 12*a*, 12*b*, and 12*c* are projected away from apertures 222*a*, 222*b*, and 222*c* respectively by virtue of elastic projections 12*a*, 12*b*, 12*c* to block any further movement of wedge members 331*a*, 332*a*, and 333*a*. This is a locked position of tray 20 and actuator 30. As a result, the mounting of tray 20 to highchair 40 is finished (see FIG. 3A).

In adjusting the horizontal position of tray 20 with respect to supports 10, 10', pull handle 31 against the elastic force of elastic elements 34*a*, 34*b*. Then cause wedge members 331*a*, 332*a*, and 333*a* of vertical member 33*a* to push elastic projections 12*a*, 12*b*, and 12*c* to force them to retract into apertures 222*a*, 222*b*, and 222*c* of engagement member 22*a* to overcome the obstruction of elastic projections 12*a*, 12*b*, and 12*c* (see FIG. 3B). At this position, tray 20 and actuator 30 are in an operating position. As a result, tray 20 is free to slide along supports 10, 10' until one wedge member 331*a*, 332*a*, or 333*a* of vertical member 33*a* is stopped by the adjacent again projected elastic projection 12*a*, 12*b*, or 12*c*. As a result, tray 20 and actuator 30 are in the locked position again. This finishes the horizontally relative positioning of tray 20 to supports 10, 10'.

If operator wants to remove tray 20 from highchair 40, simply continues the pulling procedure of handle 31 above until all wedge members 331*a*, 332*a*, and 333*a* of vertical member 33*a* are clear from apertures 222*a*, 222*b*, and 222*c* to overcome the restrictions of elastic projection 12*a*, 12*b*, and 12*c*.

Figure 5:
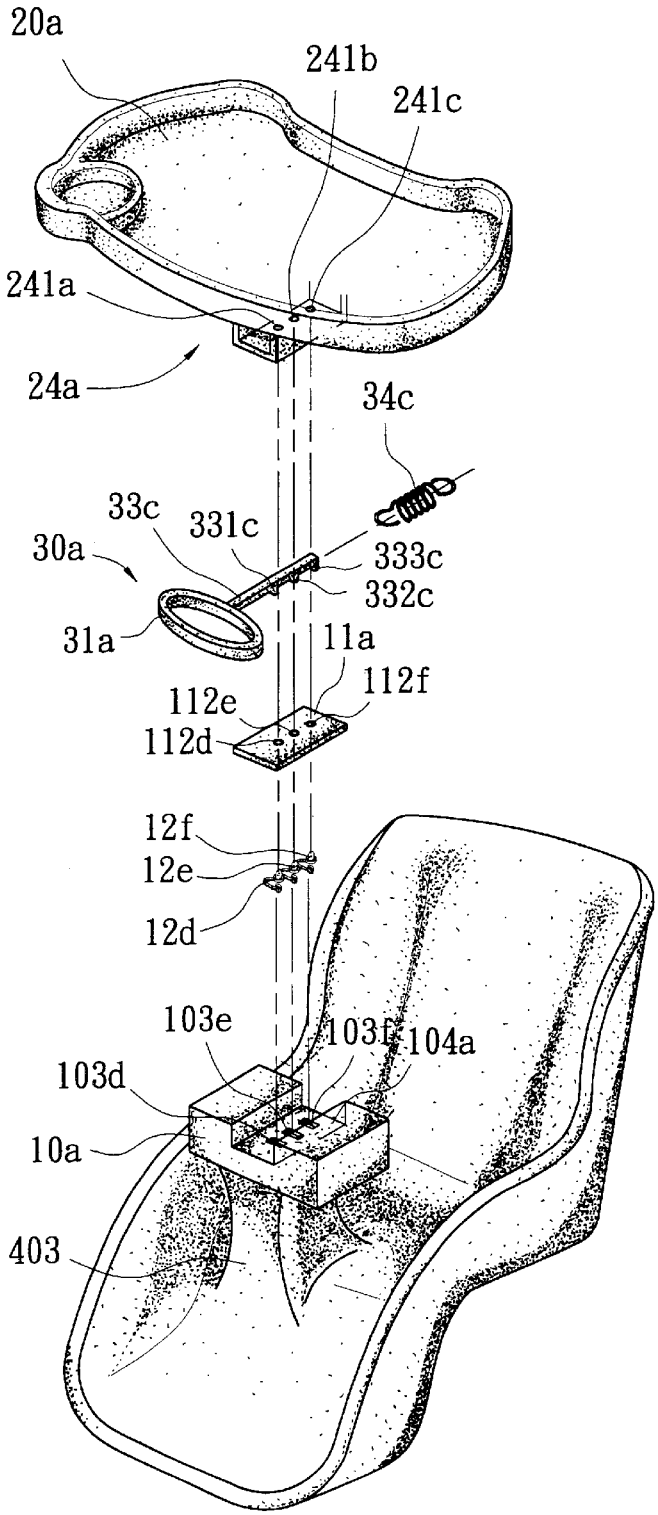
FIG. 5 is an exploded view of a horizontally adjustable tray of highchair of a second preferred embodiment according to the invention.
Figure 6:
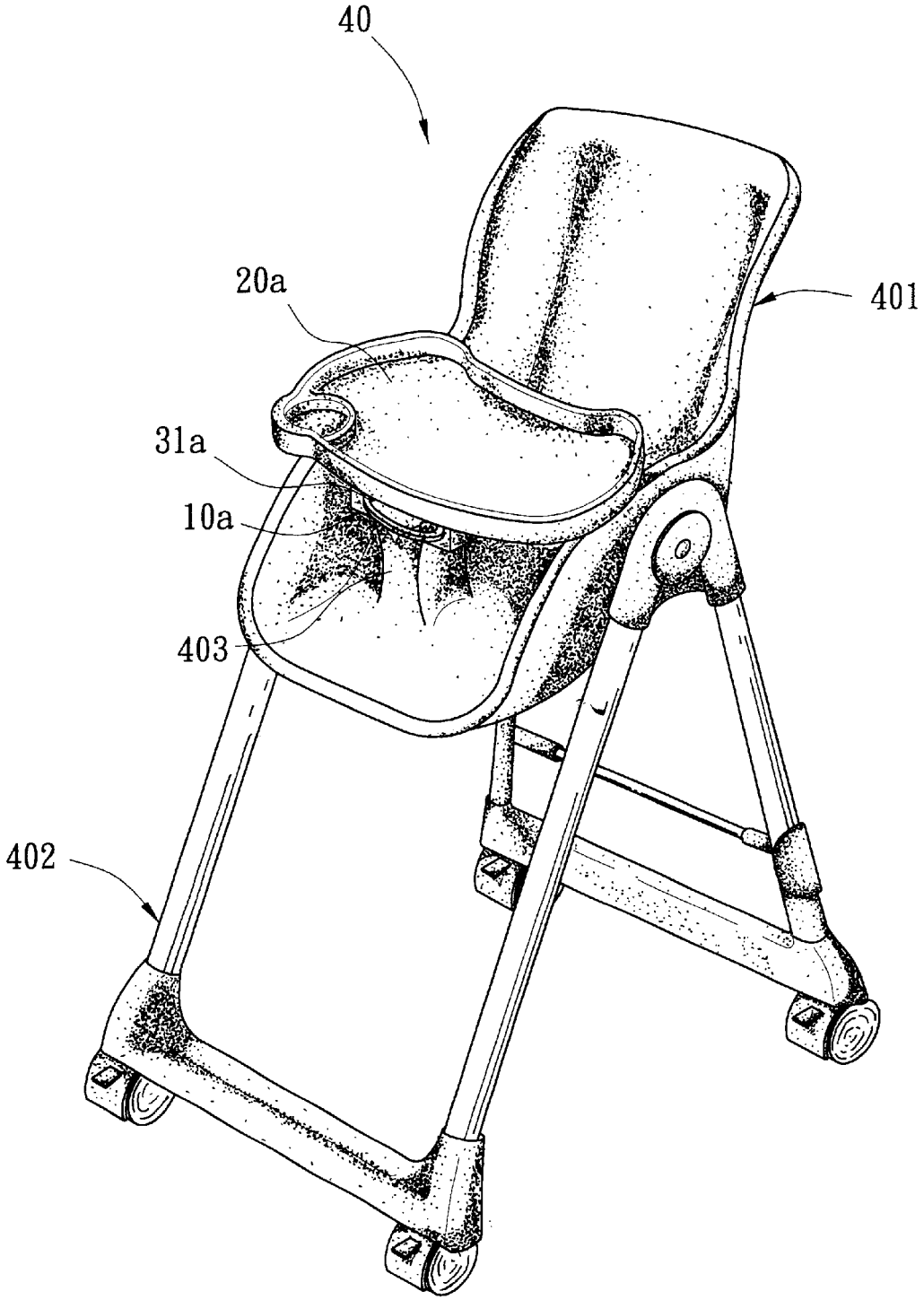
FIG. 6 is a perspective view of a highchair incorporating the horizontally adjustable tray shown FIG. 5.

Referring to FIGS. 5 and 6, there is shown a horizontally adjustable tray 20*a* of highchair 40 of a second preferred embodiment according to the invention. As shown, a centrally disposed projection 403 is raised above seat 401 of highchair 40 for preventing an infant from accidentally slipping out of seat 401. A support 10*a* is provided on top of projection 403 including a U-shaped groove 104*a*, a plurality of holes 103*d*, 103*e*, and 103*f* on the groove 104*a*, a plurality of elastic projections 12*d*, 12*e*, and 12*f* provided in holes 103*d*, 103*e*, and 103*f* respectively, and a plate 11*a* on top of elastic projections 12*d*, 12*e*, and 12*f* having a plurality of through apertures 112*d*, 112*e*, and 112*f*.

Tray 20*a* is generally the same configuration as that of the first preferred embodiment except the following: A U-shaped channel member 24*a* is provided on the underside of tray 20*a*. The width of channel member 24*a* is conformed to that of groove 104*a*. Channel member 24*a* comprises a plurality of through holes 241*a*, 241*b*, and 241*c* on the bottom.

Actuator 30*a* comprises a handle 31*a*, a vertical member 33*c* coupled to handle 31 having a plurality of protuberances 331*c*, 332*c*, and 333*c*, and an elastic element 34*c* (e.g., spring) having one end coupled to the inside of tray 20*a* and the other side coupled to vertical member 33*c* for defining the movement of vertical member 33*c*.

Figure 7A:
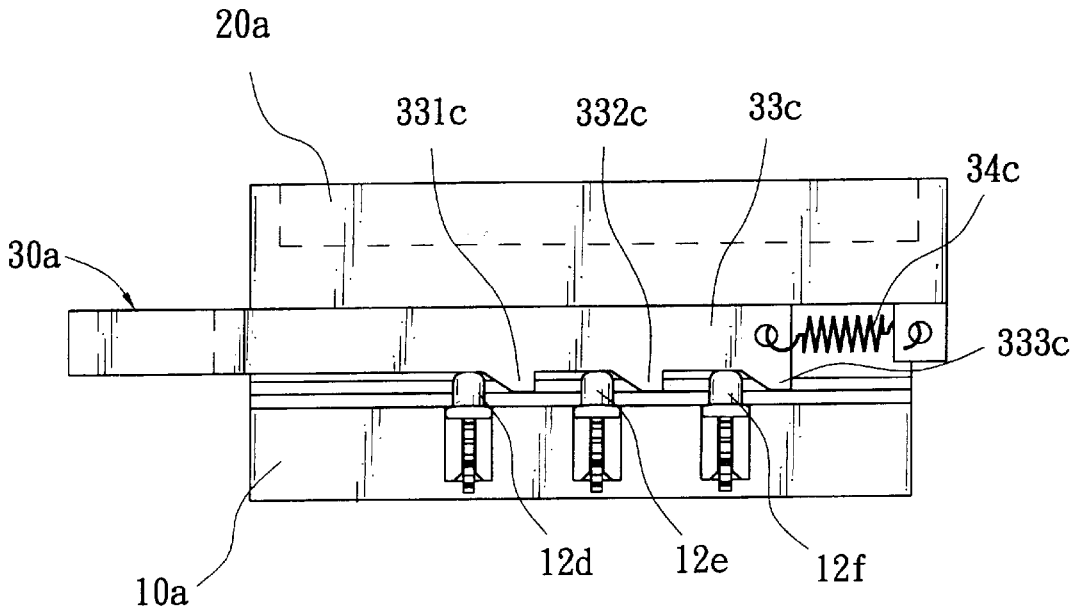
FIGS. 7A and 7B schematically depict operations of the FIG. 5 tray.

In a locked position as shown in FIG. 7A, actuator 30*a* is engaged between channel member 24*a* and groove 104, and elastic projections 12*d*, 12*e*, and 12*f* are projected above holes 103*d*, 103*e*, and 103*f* through apertures 112*d*, 112*e*, and 112*f* into the through holes 241*a*, 241*b*, and 241*c* of channel member 24*a* to stop the movements of the protuberance 331*c*, 332*c*, and 333*c* of vertical member 33*c*.

Figure 7B:
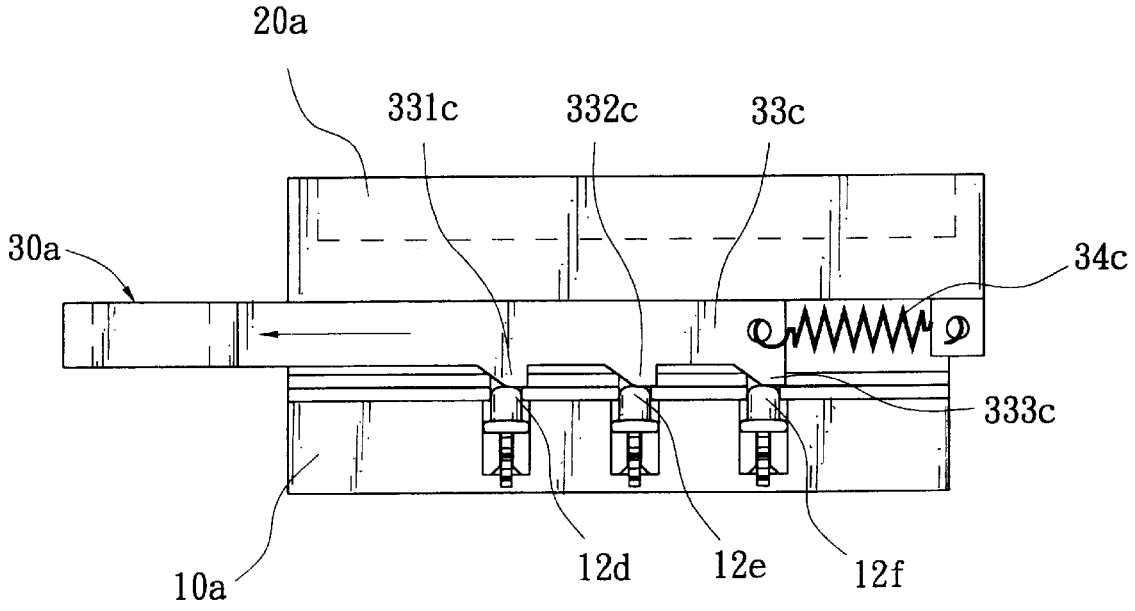

In adjusting the horizontal position of tray 20*a* with respect to support 10*a*, pull handle 31*a* against the elastic force of elastic element 34*c* to force elastic projections 12*d*, 12*e*, and 12*f* to retract into apertures 112*d*, 112*e*, and 112*f* to overcome the obstruction of elastic projections 12*d*, 12*e*, and 12*f* (see FIG. 7B). At this position, tray 20*a* is in an operating position. As a result, tray 20*a* is free to slide along support 10*a* until one protuberance 331*c*, 332*c*, or 333*c* of vertical member 33*c* is stopped by the adjacent again projected elastic projection 12*d*, 12*e*, or 12*f*. As a result, tray 20*a* is in the locked position again. This finishes the horizontally relative positioning of tray 20*a* to support 10*a*.

If operator wants to remove tray 20*a* from highchair 40, simply continues the pulling procedure of handle 31*a* above until all wedge members 331*a*, 332*a*, and 333*a* of vertical member 33*a* are clear from apertures 112*d*, 112*e*, and 112*f* to overcome the restrictions of elastic projections 12*d*, 12*e*, and 12*f*.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A highchair with a horizontally adjustable tray comprising:

a pair of supports on opposed sides of the highchair each having a plurality of studs on an inside surface thereof;

a tray movably coupled between the supports including two underlying engagement members disposed on the supports each having a plurality of apertures, each of the apertures having an elastic projection projected above the aperture so as to cause the tray to be in a locked position with respect to the supports; and an actuator slidably attached to an undersurface of the tray including two vertical members each having a plurality of wedge members corresponding in position to the apertures of the engagement member and one or more elastic elements each having one end biased against the undersurface of the tray and the other end biased against the actuator, wherein the projected elastic projections are structured to restrict the movements of the wedge members so as to effect the locking of the actuator to the tray, and the wedge members are structured to be able to move pass the retracted elastic projections to effect a disengagement of the actuator from the tray;

further wherein each of the supports further comprises a tube disposed on a leg of the highchair and a plurality of studs releasably coupled to the highchair.

2. The highchair with the horizontally adjustable tray of claim 1, wherein the tray further comprises a tray portion and a base plate.

3. The highchair with the horizontally adjustable tray of claim 2, wherein the tray portion comprises a flat central area.

4. A highchair with a horizontally adjustable tray, comprising:

a pair of supports on opposed sides of the highchair each having a plurality of studs on an inside surface thereof;

a tray movably coupled between the supports including two underlying engagement members disposed on the supports each having a plurality of apertures, each of the apertures having an elastic projection projected above the aperture so as to cause the tray to be in a locked position with respect to the supports; and an actuator slidably attached to an undersurface of the tray including two vertical members each having a plurality of wedge members corresponding in position to the apertures of the engagement member and one or more elastic elements each having one end biased against the undersurface of the tray and the other end biased against the actuator, where in the projected elastic projections are structured to restrict the movements of the wedge members so as to effect the locking of the actuator to the tray, and the wedge members are structured to be able to move pass the retracted elastic projections to effect a disengagement of the actuator from the tray;

further wherein each of the supports further comprises a plurality of slots and an elongated member engaged with the slots, said elongated member having a channel with holes corresponding in position to the slots respectively.

5. The highchair with the horizontally adjustable tray of claim 4, wherein each of the support further comprises a plurality of recesses each having an inverted-U shape formed as a receiving space for receiving the corresponding elastic projection.

6. The highchair with the horizontally adjustable tray of claim 4, wherein each of the elastic projections comprises a body and a tip projected into a corresponding hole of the elongated member.

7. The highchair with the horizontally adjustable tray of claim 4, wherein each of the engagement members comprises two inner parallel rails spaced by a distance about the width of the channel of the elongate member.

8. A highchair with a horizontally adjustable tray, comprising:

a pair of supports on opposed sides of the highchair each having a plurality of studs on an inside surface thereof;

a tray movably coupled between the supports including two underlying engagement members disposed on the supports each having a plurality of apertures, each of the apertures having an elastic projection projected above the aperture so as to cause the tray to be in a locked position with respect to the supports; and an actuator slidably attached to an undersurface of the tray including two vertical members each having a plurality of wedge members corresponding in position to the apertures of the engagement member and one or more elastic elements each having one end biased against the undersurface of the tray and the other end biased against the actuator, wherein the projected elastic projections are structured to restrict the movements of the wedge members so as to effect the locking of the actuator to the tray, and the wedge members are structured to be able to move pass the retracted elastic projections to effect a disengagement of the actuator from the tray;

the tray further comprises a tray portion and a base plate wherein the tray portion further comprises two n-shaped engagement channels each being snapped onto the engagement member.

9. A highchair with a horizontally adjustable tray, comprising:

a pair of supports on opposed sides of the highchair each having a plurality of studs on an inside surface thereof;

a tray movably coupled between the supports including two underlying engagement members disposed on the supports each having a plurality of apertures, each of the apertures having an elastic projection projected above the aperture so as to cause the tray to be in a locked position with respect to the supports; and an actuator slidably attached to an undersurface of the tray including two vertical members each having a plurality of wedge members corresponding in position to the apertures of the engagement member and one or more elastic elements each having one end biased against the undersurface of the tray and the other end biased against the actuator, wherein the projected elastic projections are structured to restrict the movements of the wedge members so as to effect the locking of the actuator to the tray, and the wedge members are structured to be able to move pass the retracted elastic projections to effect a disengagement of the actuator from the tray;

wherein the actuator further comprises a horizontal member coupled between two ends of the vertical members, and a handle coupled to the horizontal member.

* * * * *